US005689094A

United States Patent [19]

Friedli et al.

[11] Patent Number: 5,689,094

[45] Date of Patent: Nov. 18, 1997

[54] ELEVATOR INSTALLATION

[75] Inventors: Paul Friedli, Remetschwil; Karl Schneeberger, Root; Hans Peter Bornhauser, Buchrain, all of Switzerland

[73] Assignee: Inventio AG, Hergiswil, Switzerland

[21] Appl. No.: 519,787

[22] Filed: Aug. 28, 1995

[30] Foreign Application Priority Data

Aug. 30, 1994 [CH] Switzerland ..... 02645/94

[51] Int. Cl.[6] ..... B66B 1/20

[52] U.S. Cl. ..... 187/384; 187/392

[58] Field of Search ..... 187/392, 384, 187/387, 388, 389

[56] References Cited

U.S. PATENT DOCUMENTS

| | | | |
|---|---|---|---|
| 4,685,538 | 8/1987 | Kamaike | 187/121 |
| 4,979,594 | 12/1990 | Begle et al. | 187/121 |
| 5,304,752 | 4/1994 | Hayashi | 187/126 |

FOREIGN PATENT DOCUMENTS

| | | | |
|---|---|---|---|
| 246395 | 11/1987 | European Pat. Off. | B66B 1/20 |
| 341381 | 11/1989 | European Pat. Off. | B66B 1/46 |
| 1-226681 | 9/1989 | Japan | 187/384 |
| 1-247378 | 10/1989 | Japan | 187/384 |
| 2-43185 | 2/1990 | Japan | 187/384 |
| 3-272977 | 12/1991 | Japan | 187/127 |

*Primary Examiner*—Robert Nappi

*Attorney, Agent, or Firm*—Greenblum & Bernstein, P.L.C.

[57] ABSTRACT

Elevator installation. This device enables an implicit input of destination calls in elevator installations, with an information transmitter, after a corresponding enquiry, sending data to a recognition device, wherein the data can contain direct information about the desired destination floor or serve for the identification of the elevator user and thus enable access to the information, filed in a storage device, about the destination floor, with the storage device being accommodated in a processing unit of an elevator control. The communication between the recognition device and the information transmitter takes place via radio frequencies and with the aid of the obtained data, the destination floor is determined in the processing unit and conveyed to the lift control, with the allocation being communicated to the passenger on a display device, with the process of the call entry taking place automatically, contactless and independent of the orientation of the information transmitter, i.e. it need not be visible for the recognition device, with an input device being provided for changing the floor that is proposed by the processing unit.

14 Claims, 2 Drawing Sheets

ELEVATOR INSTALLATION

CROSS REFERENCE TO RELATED APPLICATIONS

This application claims the priority of Swiss Application No. CH 02 645/94-3, filed Aug. 30, 1994, the disclosure of which is incorporated herein by reference in its entirety.

BACKGROUND OF THE INVENTION

1. Field of the Invention

The invention pertains to an elevator installation having a recognition device for the recognition of calls entered at floors, wherein the recognition device forwards the received calls to the elevator control.

2. Discussion of the Background of the Invention and Material Information

European Patent Publication EP 341 381 sets forth a method and a device for the secured and convenient entry of control commands, particularly for elevator installations, in which control commands can be sent to the elevator control by means of a portable wireless transmitter. The portable transmitting unit or device has two different modes of operation, "manual, upon button pressure" and "automatically, permanent". The desired mode of operation can be set by way of an operating mode selector on the transmitting unit. In the mode of operation "manual, upon button pressure", the desired destination can be entered directly by means of a ten key keyboard mounted on the transmitting unit and thus communicated to the elevator control. In the mode of operation "automatically, permanent", the transmitting unit sends the desired destination information on to the elevator control at certain time intervals. The acknowledgement or signalling takes place on a display device mounted on the transmitting unit. The user is thus informed that his destination call has been registered and which elevator he has to use.

In the previously described method, the portable transmitting device is provided with diverse function keys and a display, which means that the transmitter must, in every instance, be taken in hand for the determination of the desired mode of operation. This is impractical when a passenger has no free hand to operate the transmitter. Moreover, in both modes of operation, the entry acknowledgement and the allocated car are indicated only on the display of the transmitter, which must therefore be taken out of the pocket, each time, in order to view the display. Beyond that, the dimensions thereof are too large due to the function keys and the display, to allow convenient carrying of the transmitter. Finally, the requirement of a keyboard and a display results in considerable manufacturing expense.

The invention has the task or object of providing a recognition device for elevator installations which, for the recognition of calls entered at floors, of the type initially described, does not include the noted disadvantages and which offers greater operating convenience to the passenger.

SUMMARY OF THE INVENTION

This task or object is achieved by the invention in the manner set forth in the appended claims.

Specifically, this invention pertains to an elevator installation having a plurality of elevators and a recognition device for the recognition of calls entered at floors, wherein the entry location of a call is the starting floor of the journey, with the call being fed to a control device and allocated to an elevator via an allocating algorithm and wherein the call is acknowledged and a proposed destination floor communicated to an elevator user via one of a display device and an acoustic device, wherein the recognition device, mounted in an access area in the vicinity of the elevators and spatially located away from elevator doors the floors, independently reads data from information transmitters carried by an elevator user and transmits the data via a storage device into the control device or, after the recognition of individual features of the lift user, transmits the data via an associated storage device, into the lift control device.

A further embodiment of the elevator installation of this invention includes an input device for changing the proposed destination floor, with the input device being located in the region of the recognition device.

In another embodiment of the elevator installation of this invention, a changed destination floor is added to the storage device.

In a differing embodiment of the elevator installation of this invention, at least one recognition device is mounted at each access area.

In yet a further embodiment of the elevator installation of this invention, the recognition device operates without physical contact with the elevator installation.

In yet another embodiment of the elevator installation of this invention, the recognition device reads a key having a code.

In yet a differing embodiment of the elevator installation of this invention, the storage device is mounted on the information transmitter.

In still a further embodiment of the elevator installation of this invention, the storage device is mounted in a processing unit.

In still another embodiment of the elevator installation of this invention, the data is information about the destination floor.

In still a differing embodiment of the elevator installation of this invention, the storage device, in addition to the destination floor, contains further transport requirement information and details about the elevator user.

In yet still a further embodiment of the elevator installation of this invention, the information transmitter reverts to an in at rest mode outside an elevator range and is activated via an external electromagnetic field.

In yet still a differing embodiment of the elevator installation of this invention, the identity of an elevator, allocated to the call, is communicated to the elevator user via one of a display device and an acoustic device.

The advantages achieved by the invention reside in the fact that the desired journey destination is communicated automatically to the elevator control by the information transmitters carried by the elevator users or by the recognition of features of the elevator users without any personal action being required by the passenger. In buildings, security is increased by access authorization for only certain floors.

Via the use of an information storage device, the elevator control, in addition to the desired floor destination, receives still additional transport requirements. With the aid of an input device mounted in the area of the elevator, the passenger can still change the journey destination. Moreover, the entry is acknowledged and the car allocated to the call is communicated to the elevator user either optically or acoustically.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have generally been used the same reference characters to denote the same or analogous components and wherein.

DETAILED DESCRIPTION OF THE PREFERRED EMBODIMENTS

With respect to the drawings it is to be understood that only enough of the construction of the invention and the surrounding environment in which the invention is employed have been depicted therein, in order to simplify the illustrations, as needed for those skilled in the art to readily understand the underlying principles and concepts of the invention.

Figure 1:
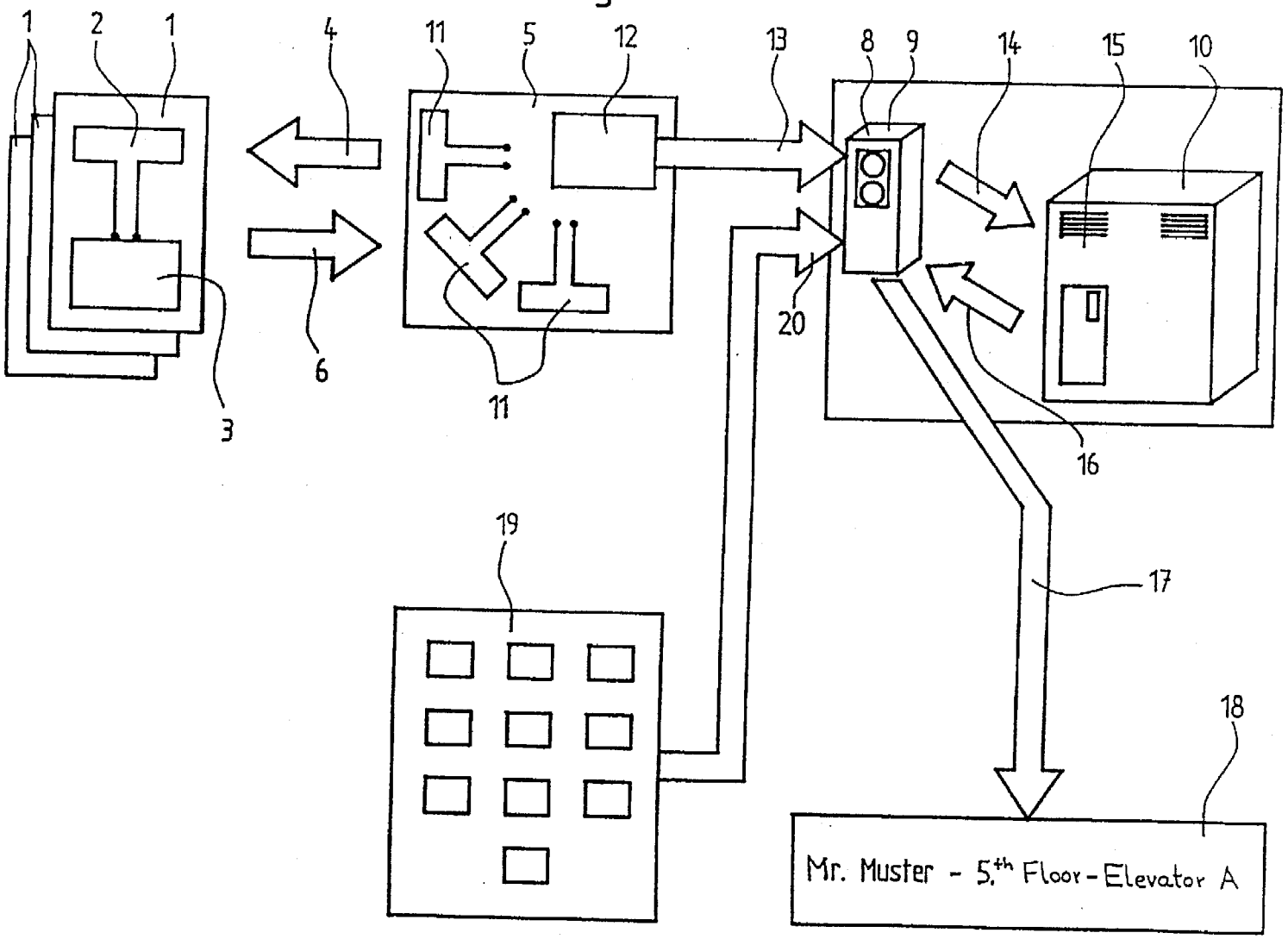
FIG. 1 is a schematic block diagram of an arrangement of an elevator installation in accordance with the invention.

FIG. 1 shows a schematic block diagram of an arrangement of an elevator installation in accordance with the invention. An information transmitter which can, for example, be executed as card of the credit card type format, is denoted by numeral 1. Information transmitter 1 consists mainly of an aerial or antenna 2 and an electronic transmitter part 3. Electronic transmitter part 3 comprises a transmitting and receiving unit and a storage device having an identification code. A battery, preferably a long life battery, is mounted on information transmitter 1 for supplying electronic system 3. There is also the possibility of executing information transmitter 1 as passive element and supplying same via an electromagnetic field. Electronic transmitter system 3 remains in an at rest mode outside of the elevator operating range and is activated by an electromagnetic field 4 radiated by a recognition device 5. Upon an appropriate inquiry by recognition device 5, information transmitter 1 sends data 6 to recognition device 5. Data 6 can contain direct information, for example the floor number, about the desired destination floor or data 6 serves for identification (identification code) of the elevator user and enables access to the information, filed in a storage device 8, about the destination floor. After a predetermined time without communication, information transmitter 1 again returns to its at rest mode. Storage device 8 is mounted in a processing unit 9 of an elevator control 10 and contains the information data about the destination floor. As a variation thereof, storage device 8, containing the destination floor information, could also be mounted directly on information transmitter 1. In the latter case, recognition device 5 directly receives the information about the destination floor. In addition, storage device 8 contains still further individual transport requirements and details of passengers such as the passenger name, details about the required space, solo journey (for example for important persons, hospital beds, foodstuff transports, refuse transport), preferential travel, prolonged door-opening times in the case of restricted mobility, operation for the physically disabled, the operational mode of car cleaning, special modes of operation in hospitals and hotels, and so forth. Recognition device 5 is equipped with one or more aerials 11 or antennas and monitors a specific building part or portion in the access or approach to an elevator installation. Device 5 independently searches the appropriate building part for information transmitters 1 and manages the communication with an electronic part 12. Electronic part 12 consists of a transmitting and a receiving unit as well as a communication management unit. The communication between recognition device 5 and information transmitter 1 occurs via radio frequencies, preferably in the range of 900 megahertz to 6 gigahertz. Storage device 8 on information transmitter 1 or processing unit 9 can be read out and preferably also written or read into via recognition device 5. Recognition device 5 passes the data 6 received from information transmitter 1 into processing unit 9 via a wire line 13. The destination floor is determined in processing unit 9 with the aid of data 6 and a corresponding call 14 is generated by an allocating algorithm 15 for elevator control 10. The obtained allocation 16 can, for example, be combined with the name of the passenger, the destination floor or a transport requirement and be communicated to the passenger. This occurs either by way of a wire line 17 and a display 18 or acoustically, for example via speech synthesis. In the case of an elevator installation with only one elevator, the announcement of an allocation 16 becomes superfluous. As long as processing unit 9 cannot derive a probable destination with the aid of data 6, it requests the passenger, upon his being recognized via display 18 or acoustically, to enter his destination at an input device 19. Processing unit 9 operates either with its own computer or is integrated into elevator control 10. Elevator control 10 operates in a known manner, for example as a destination control, in the manner set forth in European Patent Publication EP 246 395. The entire operation of the call entry takes place hands-free, contactless and independent of the orientation of information transmitter 1, which also means that information transmitter 1 need not be visible for the identification thereof by recognition device 5. The compact mode of construction with a minimum fitting of components enables very inexpensive manufacturing of information transmitters 1.

When the passenger wants to travel to a floor other than that proposed by processing unit 9 or the passenger has no information transmitter 1, the destination floor can be changed or chosen via input device 19. Input equipment 19, which for example is constructed as a ten key keyboard, is mounted in the area of recognition device 5 and is in direct connection 20 with processing unit 9. The new destination floor is augmented or added in storage device 8. This procedure makes it possible that processing unit 5 can now evaluate the usual destination floors of the passenger with the aid of the identified person, the time of day, the day of the week day and the starting floor.

As a variation, recognition device 5 can also be so arranged that it recognizes a passenger with the aid of an individual feature, for example in an optical manner (facial contours, finger prints, iris, etc.) or by reason of the speech thereof. In the case of agreement with features contained in storage device 8, recognition device 5 sends a report to processing unit 9. In this case, an information transmitter 1 is not required. For changing the proposed destination floor, an input device 19 is also required. Processing unit 9 then evaluates the call in the manner of the previously described embodiment.

To assure building security, input equipment 19 may be dispensed with. Thus, the passenger can only reach floors, to which he has authorized access. This access authorization is ascertained with the aid of the information data contained in storage device 8. In a hotel, this can for example be the main stop and the room floor.

Information transmitter 1 can also be mounted on any desired object. In the case of elevators in multistory carparks or parking garages of department stores and airports, the problem exists that it is not known in advance whether the passenger does or does not have a luggage or shopping cart or trolley. The space management in the elevators must thus be planned correspondingly different. Via information transmitters 1 mounted on the carts, it can readily be recognized whether the passenger does or does not have a cart. In multistory carparks, the car driver receives a card with an information transmitter 1 upon arrival. This card serves, at the same time, as the ticket for payment of the parking fee. On his parking floor, the driver also possibly takes a luggage cart. As soon as he approaches the elevator, he and the possible cart are recognized by recognition device 5 and his card (information transmitter 1) is inscribed with the location of the subject floor. The destination, in the case of multistory carparks, is always the main stop of the building so that he immediately receives an optimum elevator allocation which also takes his space requirements into consideration. The passenger is now brought to his destination. When he returns to the main stop, he is brought automatically, with or without cart to the specific floor, where his car is parked. At the check point when leaving the multistory carpark, the car (information transmitter 1) is relinquished. This variation can also be utilized in hotels, where the card (information transmitter 1) additionally serves as the room key. The main stop and the floor, where the corresponding room is situated, are preset as destination floors.

A further variation consists in that information transmitter 1 is not carried along as separate card, but executed as coded key means. For example, in a residential or in an office building, the building key can be provided with information transmitter 1. Recognition device 5 is then mounted at the door lock so that elevator control 10 also receives the destination call upon the opening of the door. In an office building, the process can take place via operation of the time clock for time recordation purposes.

Figure 2:
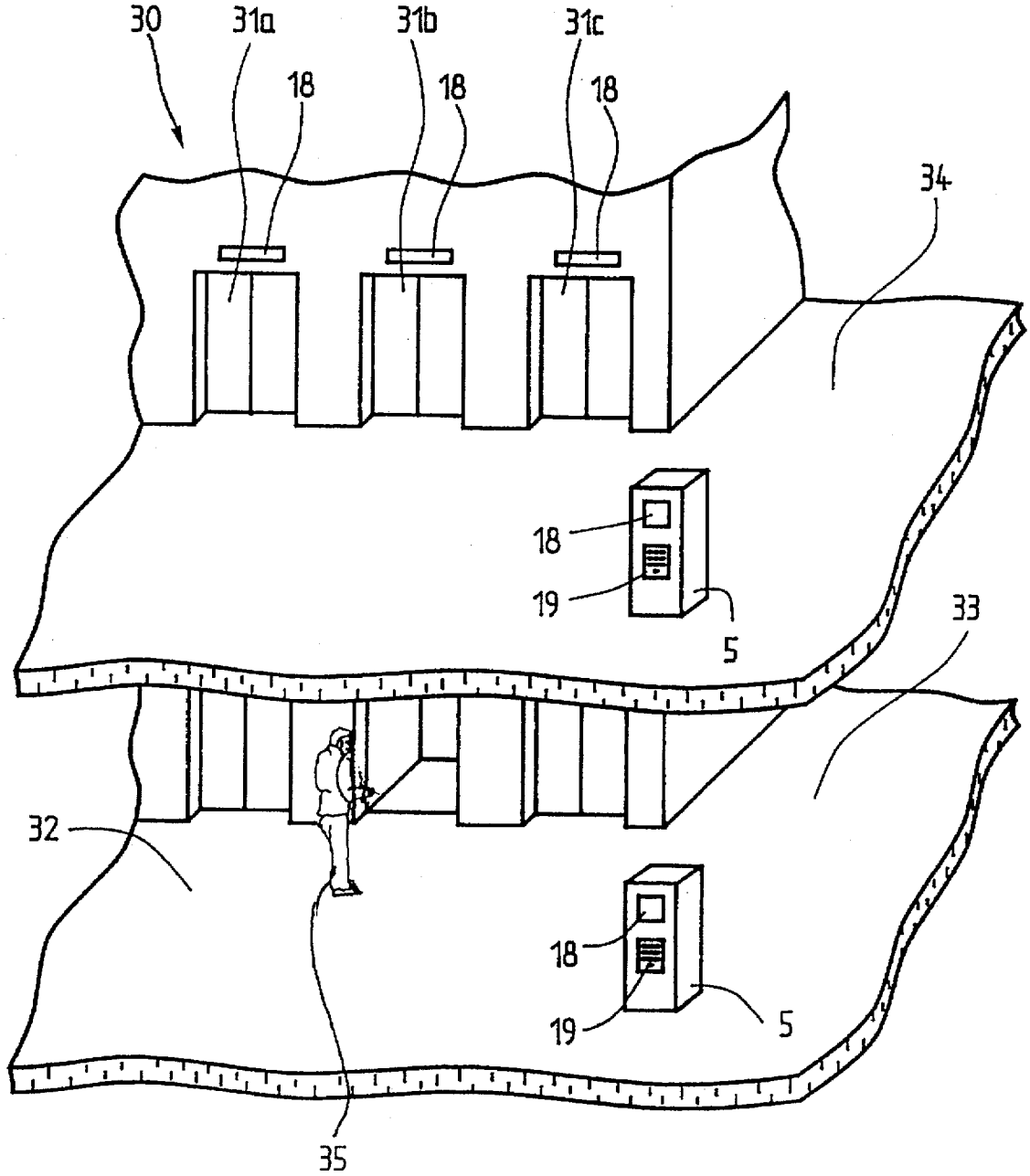
FIG. 2 shows an arrangement and a basic lay-out of an installation for using the device of the instant invention.

FIG. 2 shows an arrangement the basic layout of an elevator installation 30 for applying the method of this invention. An elevator group with the lifts 31*a*, 31*b* and 31*c* leads from main stop or floor 32, having an entrance or access 33 to the upper floors. At least one recognition device 5 is mounted in the region or area of accesses 33 and 34 of each floor. The transmitting and receiving range of a recognition device 5 comprises the access associated therewith. Recognition devices 5 are spaced a few steps away from elevators 31*a*, 31*b* and 31*c* so that the journey destination is communicated to elevator control 10 early and the allocated elevator arrives at the shaft door, if possible, already before or at the same time as the passenger. Thus, a passenger 35 can be recognized and an elevator 31*a*, 31*b* or 31*c* can be presented and be ready without the passenger having to stand directly in front of recognition device 5. An input device 19, for changing the proposed destination floor, is arranged in the area of recognition device 5. Display devices 18 are situated above or laterally of the floor doors and/or at input equipment 19. Passenger 35 is informed of the allocated elevator and the journey destination, implicitly indicated by information transmitter 1, before elevator 31*a*, 31*b* or 31*c* is situated on the boarding floor. If passenger 35 would now like to choose a different journey destination, he can do this explicitly at input device 19, with the implicitly entered call being annulled thereby. Processing unit 9 notes this change and will, for this passenger 35, retain the new journey destination ready for lift control 10, each time, at the same time of the day. After a certain time, so much statistical material about the passenger 35 accumulates in storage device 8 that, during the maintenance of constant habits, he is automatically brought to the correct journey destination.

While there are shown and described present preferred embodiments of the invention, it is to be distinctly understood that the invention is not limited thereto, but may be otherwise variously embodied and practiced within the scope of the following claims and the reasonably equivalent structures thereto. Further, the invention illustratively disclosed herein may be practiced in the absence of any element which is not specifically disclosed herein.

What is claimed is:

1. An elevator installation having a plurality of elevators comprising:

a recognition device for recognizing elevator calls entered at an entry location by an information transmitter carried by an elevator user, initializing the entry location as a starting floor of a journey;

a control device receiving the recognized elevator call and allocating an elevator to respond to the elevator call, through a predetermined allocating algorithm;

a call acknowledging device comprising one of a display device and an acoustic device to acknowledge recognition of the elevator call and to communicate a proposed destination floor to the elevator user;

the recognition device, mounted in the access area in the vicinity of the elevators and spatially located away from elevator doors, actuating the information transmitter and comprising a unit that independently reads data transmitted from the information transmitter carried by the elevator user and a storage device coupled between the unit and the control device:

the recognition device one of transmitting proposed destination floor data, based upon the data transmitted from the information transmitter, to the control device, and, transmitting elevator user specific data. based upon individual features of the elevator user stored in the storage device, to the control device.

2. The elevator installation of claim 1, further including an input device for changing the proposed destination floor, with the input device being located in the region of the recognition device.

3. The elevator installation of claim 1, wherein a changed destination floor is added to the storage device.

4. The elevator installation of claim 2, wherein a changed destination floor is added to the storage device.

5. The elevator installation of claim 1, wherein at least one recognition device is mounted at each access area.

6. The elevator installation of claim 1, wherein the recognition device operates without physical contact with the elevator installation.

7. The elevator installation of claim 1, wherein the recognition device reads a key having a code.

8. The elevator installation of claim 1, wherein the storage device is mounted on the information transmitter.

9. The elevator installation of claim 1, wherein the storage device is mounted in a processing unit.

10. The elevator installation of claim 1, wherein the data is information about the destination floor.

11. The elevator installation of claim 1, wherein the storage device, in addition to the destination floor, contains further transport requirement information and details about the elevator user.

12. The elevator installation of claim 1, wherein the information transmitter reverts to an in at rest mode outside an elevator range and is activated via an external electromagnetic field.

13. The elevator installation of claim 1, wherein the identity of an elevator, allocated to the call, is communicated to the elevator user via one of a display device and an acoustic device.

14. An elevator installation having a plurality of elevators comprising:

a recognition device for recognizing elevator calls entered at an entry location by an information transmitter carried by an elevator user, initializing the entry location as a starting floor of a journey;

a control device receiving the recognized elevator call and allocating an elevator to respond to the elevator call, through a predetermined allocating algorithm;

a call acknowledging device comprising one of a display device and an acoustic device to acknowledge recognition of the elevator call and to communicate a proposed destination floor to the elevator user;

the recognition device, mounted in an access area in the vicinity of the elevators and spatially located away from elevator doors, actuating the information transmitter and comprising a unit that independently reads data transmitted from the information transmitter carried by the elevator user and a storage device coupled between the unit and the control device;

the recognition device transmitting the data through the storage device and to the control device.

* * * * *

US005689094C1

(12) EX PARTE REEXAMINATION CERTIFICATE (9432nd)

United States Patent

Friedli et al.

(10) Number: US 5,689,094 C1

(45) Certificate Issued: Dec. 11, 2012

(54) ELEVATOR INSTALLATION

(75) Inventors: Paul Friedli, Remetschwil (CH); Karl Schneeberger, Root (CH); Hans Peter Bornhauser, Buchrain (CH)

(73) Assignee: Inventio AG, Hergiswil NW (CH)

Reexamination Request:
No. 90/011,395, Dec. 21, 2010
No. 90/012,103, Jan. 24, 2012

Reexamination Certificate for:

| | |
|---|---|
| Patent No.: | **5,689,094** |
| Issued: | **Nov. 18, 1997** |
| Appl. No.: | **08/519,787** |
| Filed: | **Aug. 28, 1995** |

(30) Foreign Application Priority Data

| | | |
|---|---|---|
| Nov. 1, 1987 | (EP) | 246395 |
| Sep. 1, 1989 | (JP) | 1-226681 |
| Oct. 1, 1989 | (JP) | 1-247378 |
| Nov. 1, 1989 | (EP) | 341381 |
| Feb. 1, 1990 | (JP) | 2-43185 |
| Dec. 1, 1991 | (JP) | 3-272977 |
| Aug. 30, 1994 | (CH) | 2645/94 |

(51) Int. Cl.
*B66B 1/20* (2006.01)
*B66B 1/24* (2006.01)

(52) U.S. Cl. ..... 187/384; 187/392

(58) Field of Classification Search ..... None
See application file for complete search history.

(56) References Cited

To view the complete listing of prior art documents cited during the proceedings for Reexamination Control Numbers 90/011,395 and 90/012,103, please refer to the USPTO's public Patent Application Information Retrieval (PAIR) system under the Display References tab.

*Primary Examiner* — Colin LaRose

(57) ABSTRACT

Elevator installation. This device enables an implicit input of destination calls in elevator installations, with an information transmitter, after a corresponding enquiry. sending data to a recognition device, wherein the data can contain direct information about the desired destination floor or serve for the identification of the elevator user and thus enable access to the information, filed in a storage device, about the destination floor, with the storage device being accommodated in a processing unit of an elevator control. The communication between the recognition device and the information transmitter takes place via radio frequencies and with the aid of the obtained data, the destination floor is determined in the processing unit and conveyed to the lift control, with the allocation being communicated to the passenger on a display device, with the process of the call entry taking place automatically, contactless and independent of the orientation of the information transmitter, i.e. it need not be visible for the recognition device, with an input device being provided for changing the floor that is proposed by the processing unit.

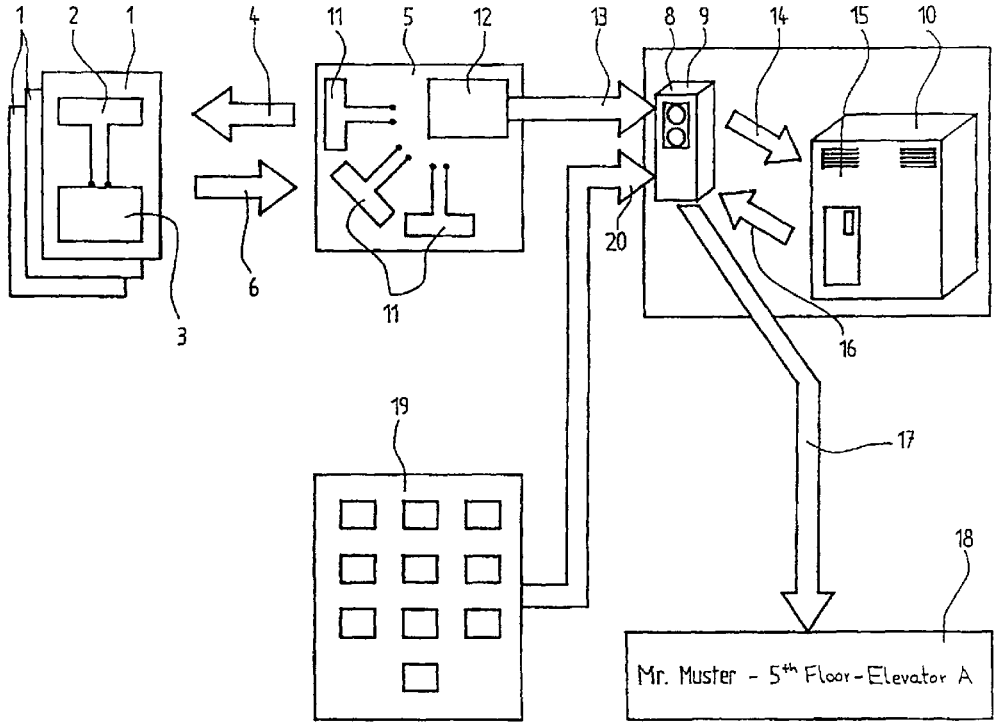

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claim 14 is confirmed.

Claim 1 is determined to be patentable as amended.

Claims 2-13, dependent on an amended claim, are determined to be patentable.

New claims 15-25 are added and determined to be patentable.

1. An elevator installation having a plurality of elevators comprising:

a recognition device for recognizing elevator calls entered at an entry location by an information transmitter carried by an elevator user, initializing the entry location as a starting floor of a journey;

a control device receiving the recognized elevator call and allocating an elevator to respond to the elevator call, through a predetermined allocating algorithm;

a call acknowledging device comprising one of a display device and an acoustic device to acknowledge recognition of the elevator call and to communicate a proposed destination floor to the elevator user;

the recognition device, mounted in the access area in the vicinity of the elevators and spatially located away from elevator doors, actuating the information transmitter and comprising a unit that independently reads data transmitted from the information transmitter carried by the elevator user and a storage device coupled between the unit and the control device:

the recognition device one of transmitting proposed destination floor data, based upon the data transmitted from the information transmitter, to the control device, and, transmitting elevator user specific data[.], based upon individual features of the elevator user stored in the storage device, to the control device.

*15. The elevator installation of claim 14, wherein the storage device contains user specific data, based upon individual features of the elevator user, such that user specific data can be transmitted to the control device.*

*16. An elevator installation having a plurality of elevators comprising:*

*a recognition device for recognizing elevator calls entered at an entry location by an information transmitter carried by an elevator user, initializing the entry location as a starting floor of a journey;*

*a control device receiving the recognized elevator call and allocating an elevator to respond to the elevator call, through a predetermined allocating algorithm;*

*a call acknowledging device comprising one of a display device and an acoustic device to acknowledge recognition of the elevator call and to communicate a proposed destination floor to the elevator user;*

*the recognition device, mounted in the access area in the vicinity of the elevators and spatially located away from elevator doors, actuating the information transmitter and comprising a unit that independently reads data transmitted from the information transmitter carried by the elevator user and a storage device coupled between the unit and the control device;*

*the recognition device transmitting elevator user specific data, based upon individual features of the elevator user stored in the storage device, to the control device, wherein the storage device, in addition to the destination floor, contains further transport requirement information and details about the elevator user.*

*17. The elevator installation of claim 16, wherein the individual features of the user stored in the storage device comprises a passenger name.*

*18. The elevator installation of claim 16, wherein the individual features of the user stored in the storage device comprises a solo journey indicator.*

*19. The elevator installation of claim 16, wherein the individual features of the user stored in the storage device comprises a preferential travel indicator.*

*20. The elevator installation of claim 16, wherein the individual features of the user stored in the storage device comprises a prolonged door opening time.*

*21. The elevator installation of claim 16, wherein the individual features of the user stored in the storage device comprises a physically disabled indicator.*

*22. The elevator installation of claim 16, wherein the individual features of the user stored in the storage device comprises a car cleaning mode indicator.*

*23. The elevator installation of claim 1, wherein the proposed destination floor data and the elevator user specific data are both transmitted.*

*24. An elevator installation having a plurality of elevators comprising:*

*a recognition device for recognizing elevator calls entered at an entry location by an information transmitter carried by an elevator user, initializing the entry location as a starting floor of a journey;*

*a control device receiving the recognized elevator call and allocating an elevator to respond to the elevator call, through a predetermined allocating algorithm;*

*a call acknowledging device comprising one of a display device and an acoustic device to acknowledge recognition of the elevator call and to communicate a proposed destination floor to the elevator user;*

*the recognition device, mounted in the access area in the vicinity of the elevators and spatially located away from elevator doors, actuating the information transmitter and comprising a unit that independently reads data transmitted from the information transmitter carried by the elevator user and a storage device coupled between the unit and the control device;*

*the recognition device transmitting proposed destination floor data, based upon the data transmitted from the information transmitter, to the control device, the storage device, in addition to the destination floor, containing further transport requirement information and details about the elevator user.*

*25. An elevator installation having a plurality of elevators comprising:*

*a recognition device for recognizing elevator calls entered at an entry location by an information transmitter carried by an elevator user, initializing the entry location as a starting floor of a journey;*

*a control device receiving the recognized elevator call and allocating an elevator to respond to the elevator call, through a predetermined allocating algorithm;*

*a call acknowledging device comprising one of a display device and an acoustic device to acknowledge recognition of the elevator call and to communicate a proposed destination floor to the elevator user;*

*the recognition device, mounted in the access area in the vicinity of the elevators and spatially located away from elevator doors, actuating the information transmitter and comprising a unit that independently reads data transmitted from the information transmitter carried by the elevator user and a storage device coupled between the unit and the control device:*

*the recognition device transmitting proposed destination floor data, based upon the data transmitted from the information transmitter, to the control device, and, transmitting elevator user specific data, based upon individual features of the elevator user stored in the storage device, to the control device, the storage device, in addition to the destination floor, containing further transport requirement information and details about the elevator user.*

* * * * *